US005255066A

United States Patent [19]

Jäger

[11] Patent Number: 5,255,066

[45] Date of Patent: Oct. 19, 1993

[54] MEASURING DEVICE FOR TRACK BUILDING MACHINES

[75] Inventor: Heinz Jäger, Volketswil, Switzerland

[73] Assignee: Matisa Materiel Industriel, S.A., Crissier, Switzerland

[21] Appl. No.: 895,374

[22] Filed: Jun. 8, 1992

[30] Foreign Application Priority Data

Jun. 10, 1991 [CH] Switzerland ..... 1721/91

[51] Int. Cl.[5] ..... G01B 11/26

[52] U.S. Cl. ..... 356/152; 356/140; 356/141

[58] Field of Search ..... 356/140, 141, 152

[56] References Cited

U.S. PATENT DOCUMENTS 3,821,932 7/1974 Theurer et al. .
4,643,567 2/1987 Dröscher et al. ..... 356/152
4,811,062 3/1989 Tabata et al. ..... 356/152
4,936,678 6/1990 Gordon et al. ..... 356/152

FOREIGN PATENT DOCUMENTS 0051338 8/1984 European Pat. Off. .

OTHER PUBLICATIONS

Swiss Search Report.

*Primary Examiner*—Mark Hellner
*Attorney, Agent, or Firm*—Kane, Dalsimer, Sullivan, Kurucz, Levy, Eisele & Richard

[57] ABSTRACT

The measuring device for track building machines comprises an optical receiver device having two lenses (1, 2) aligned in one axis (3) and in each case at least one associated sensor strip (4, 5). The projections of light sources (A, B, C) disposed outside the receiver device onto the sensor strips (4, 5) produce signals which are evaluated and determine the size of the angle of the light source in relation to the optical axis. The provision of light-sensitive sensor strips (4, 5) makes it possible to dispense in an advantageous manner with mechanically rotating components in the receiver device.

13 Claims, 1 Drawing Sheet

MEASURING DEVICE FOR TRACK BUILDING MACHINES

BACKGROUND OF THE INVENTION

A. Field of the Invention

The present invention relates to a measuring device for track building machines, which comprises an optical receiver device for receiving light waves emitted by light sources situated on both sides of and at a distance from the measuring device, and an evaluation device.

B. Description of the Prior Art

In the construction of new track installations or the restoration of existing track installations, particularly for railways, measuring devices are required to enable the course of the track to be accurately determined and, in particular, to be adapted to requirements or corrected. Measuring devices of this kind conventionally consist of an optical measuring system utilising three reference points at a distance from one another on the path of the track for the purpose of determining the course of the latter. For straight horizontal stretches these three points must lie in one line, but on curves, for example, these three reference points must be offset to a certain extent in relation to one another. This offset is measured and evaluated. The layout of the track must if necessary be corrected in accordance with the evaluation.

OBJECTIVES AND SUMMARY OF THE INVENTION

Conventional optical measuring devices have motor-driven lens discs which at the middle reference point project onto appropriately disposed sensors the light waves radiated by means of lamps in the two outer reference points. The relative positions of the two outer reference points in relation to the optical axis of the measuring device are in this case conventionally ascertained and evaluated by time measurement.

The object of the present invention thus consisted in finding a measuring device which does not need movable parts and thus eliminates wear and the consequent increasing inaccuracy of measurement.

According to the invention this object is achieved in that two lenses are provided which are disposed at a distance from one another in one axis, and that between the two lenses at least one sensor having a plurality of light-sensitive points is in each case disposed in such a manner that light rays entering through the respective lens are projected, in accordance with their entry angle onto the lens, onto the corresponding zone of the sensor, and that an evaluation logic circuit is provided which brings together and evaluates the signals produced by the sensors.

Preferred embodiments of the invention are described in Claims 2 to 12.

The measuring device according to the invention has the advantage of having no moving parts, so that constant accuracy of measurement is ensured throughout the useful life of the device, since there is no wear on moving parts of the optical system to reduce the accuracy of measurement in dependence on the length of time during which the device is used. Moreover, the measuring device can be of very compact construction and is insensitive to shocks and rough transport conditions.

BRIEF DESCRIPTION OF THE DRAWINGS

One exemplary embodiment of the invention is explained more fully below with reference to the drawings, in which.

DETAILED DESCRIPTION OF THE PREFERRED EMBODIMENT

Figure 1:
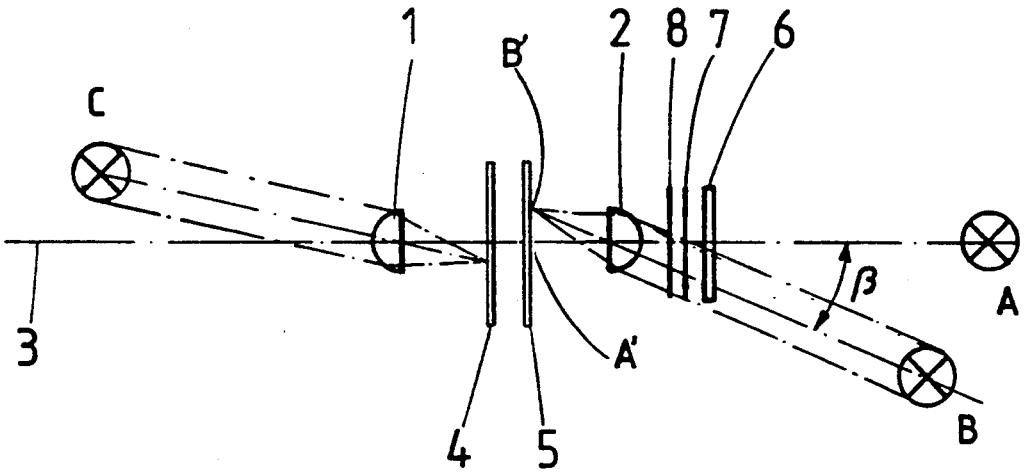
FIG. 1 shows the arrangement according to the invention of the measuring optical system with sensor strips.

A sensor strip 4, 5 is disposed in the middle of the optical axis 3 formed by each of two lenses 1, 2 of semi-circular cross-section. These strips are so disposed that the light rays collected by the lenses are, in dependence on the position of the corresponding light sources, projected, focused as a fine line of light, along the sensor strips. In the example the light source A lying on the optical axis 3 is projected onto the point A' of the sensor strip 5. A light source B lying outside the optical axis 3 is correspondingly projected onto the point B' of the sensor strip 5. The distance between the projected point on the sensor strip and the point of the optical axis on the sensor strip is a measure of the angle $\beta$ of the light source relative to the optical axis at that point. In order to filter out stray light, according to the invention a colour filter 6 and polarisation filters 7, 8 are in addition disposed in front of the lens 2. It can thus be ensured that only light from a particular light source will fall on the sensor strips and that an unambiguous signal can be produced. In particular when use is made of highly sensitive CCD (charge coupled device) sensors, only a relatively small amount of light should fall on the sensors. By adjusting the two polarisation filters 7, 8 so that they are turned at about 90° to one another, a very large proportion of the incident light is absorbed. If very powerful light sources are now used, only a small part of these light rays will be allowed through onto the sensors and all other extraneous light sources will be filtered out. By disposing one lens and one sensor strip on each side of the optical axis, the angles of each one or more light sources on both sides of the measuring arrangement relative to the optical axis can be determined and evaluated. In the embodiment illustrated the optical axis is actually a plane, and for complete measurement of the angle of the light source relative to two optical planes, two of the measuring devices described will correspondingly be required, their optical planes being so disposed as to be turned at a certain angle, preferably 90°, to one another. However, it is also conceivable to use only one measuring device, which is mounted in a casing for rotation about its optical axis, and to determine the two angles by two measurements spaced apart in time in each case, or to use square sensors which, with an appropriate optical system, for example a biconvex lens, simultaneously measures both axes through the light focused to point form.

In an embodiment which is likewise conceivable, provision is made for the duplication of the measuring device described, with in each case two pairs of cylindrical lenses, turned at preferably 90° to one another, together with the correspondingly allocated pairs of sensor strips, for the purpose of determining the angle of incidence of the light in two optical planes, the measuring device thus duplicated being disposed so as to be turned about its longitudinal optical axis at a certain angle, preferably 45°, relative to a plane, for example a horizontal plane. With this embodiment the effect is achieved that a plurality of light sources lying in the same plane can be distinguishably detected and evaluated by the sensor strips.

Figure 2A:
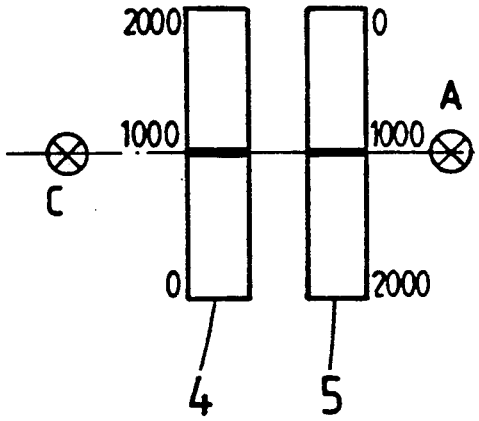
FIGS. 2*a* and 2*b* show schematically the sensor strips with different positions of the light sources.

The nature of the evaluation will be explained with reference to FIG. 2. For the sake of greater clarity the two sensor strips are there shown with their operative faces side by side. A sensor strip consists here, for example, of 2000 individual light-sensitive cells. All the cells are scanned in respect of their state cyclically from cell 0 to cell 2000 by means of a pulse generator logic circuit. The first cell 0 is in this arrangement disposed in the sensor strips 4, 5, which are arranged one behind the other, at respective opposite ends of the sensor strip. In accordance with the intensity of the light falling on each individual cell a certain voltage value is produced as said state. In the example illustrated in FIG. 2*a* the two light sources A and C lie on the optical axis of the measuring device. The light ray collected in each case by the optical system illuminates the cell 1000 on both sensor strips. This means that in the cyclical scanning of their state the cells 0 to 999 and 1001 to 2000 of both sensor strips 4, 5 produce no voltage in each case, while each of the cells 1000 produces a certain voltage value. The scanning cycles of the two sensor strips are now synchronised, and at the same time a count module is provided, which at a first positive signal of a cell of the one sensor strip in accordance with the scanning cycle starts the counting process, and on the second arrival of a signal of a cell of the other sensor strip interrupts the counting process. The direction of counting, that is to say the sign of the counter, is fixed by the respective sensor strip. For example, a signal from the sensor strip 4 causes the counter to count forwards, and a signal from the sensor strip 5 causes the counter to count backwards. The counter is so constructed that in the event of the simultaneous arrival of a signal from both the sensor strips the signal is suppressed. Thus the reading of the counter after a complete scanning cycle corresponds to the differential angle between the two relative angles of the light sources A and C of the optical axis, the sign determining the applicable side of the angle, that is to say in the upward or downward direction. Before the commencement of a scanning cycle the reading of the counter is always set to zero. In accordance with the number and spacing of the cells on the sensor strip and the design of the lenses a direct relationship between the counter reading and the relative angle can be established in degrees and displayed with the aid of appropriate means or processed in another evaluation logic circuit. The advantage of direct measurement of the relative angle consists in particular in that any offset of the optical axis is thereby compensated. If in fact the two light sources lie on an axis which passes through the optical centre of the mesuring device, the differential angle is correctly given as 0.

Figure 2B:
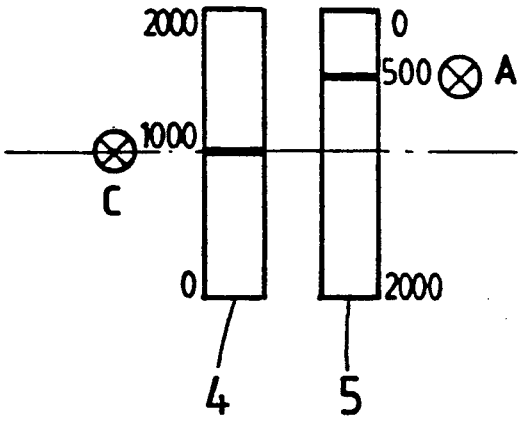

With an arrangement of the light sources relative to the measuring device in accordance with FIG. 2*b*, after 500 pulses of each scanning cycle the counter will start forward counting on a signal from the sensor strip 5. After 500 more pulses, at the pulse number 1000, the counting process is stopped by a signal from the sensor strip 4. The count of the counter accordingly amounts to 500 units, which corresponds to a certain angle value in degrees in the upward direction between the connection of the light source C to the measuring device and the connection of the light source A to the measuring device. This value is finally used for checking the measurement points and if necessary for correcting the linearity of the tracks.

Instead of CCD sensors it is also possible to use other sensors, for example PSD (position-sensitive detector) sensors.

I claim:

1. A measuring device for track building machines comprising:

a first and a second light source;

a first and a second lens disposed between said light sources at a preselected distance along an axis;

an optical receiver disposed between said two lenses and including at least one light sensor having a plurality of sensor zones for generating signals in response to light waves, said sensor being arranged to receive light waves from said light sources through said respective lenses, with said light waves being projected on one of said zones in accordance with an angular position of said first light source with respect to said axis; and evaluation means for evaluating said signals from said light sensor.

2. The measuring device according to claim 1 further comprising a first and a second color glass filter disposed respectively in front of said first and second lens.

3. The measuring device according to claim 1 further comprising a first and a second polarization filter disposed respectively in front of said first lens.

4. The measuring device according to claim 1 wherein said sensor is a charge-coupled device having more than 1000 light sensitive cells.

5. The measuring device according to claim 4 wherein said charge-coupled device is colored and wherein said cells are arranged in a plurality of rows.

6. The measuring device of claim 1 wherein said sensor is a position-sensitive detector generating a continuous output signal.

7. The measuring device of claim 1 wherein said lenses are cylindrical lenses having a semicircular cross-section to generate a linear projection.

8. The measuring device of claim 1 wherein said lenses are biconvex lenses.

9. The measuring device of claim 8 wherein said sensor is a surface sensor.

10. The measuring device of claim 1 wherein said evaluation means includes a pulse generator logic circuit operating said sensor and a counting logic circuit evaluating said signals from said sensors.

11. The measuring device of claim 1 wherein said lenses are polydimensional.

12. A system for track building machines comprising:

(a) a first measuring device having:

(i) two first light sources;

(ii) two first lenses disposed between said first light sources at a preselected distance along a first longitudinal axis, wherein said first lenses are cylindrical lenses have semicircular cross sections, and are oriented along a first optical axis disposed at a preselected angle with respect to said first longitudinal axis;

(iii) a first optical receiver disposed between said two first lenses and including at least a first light sensor having a plurality of first sensor zones for generating first signals in response to light waves, said first sensor being arranged to receive light waves from said first light sources through said first respective lenses, with said light waves being projected on one of said first zones in accordance with said first preselected angle; and (iv) first evaluation means for evaluating said first signals from said first light sensor; and a second measuring device having:

(i) two second light source;

(ii) two second lenses disposed between said second light sources at said preselected distance along a second longitudinal axis, wherein said second lenses are cylindrical lenses, have semicircular cross sections and are oriented along a second optical axis disposed at said preselected angle with respect to said second longitudinal axis;

(iii) a second optical receiver disposed between said two second lenses and including at least one second light sensor having a plurality of second sensor zones for generating second signals in response to light waves, said second sensor being arranged to receive light waves from said second light sources through said respective second lenses, with said light waves being projected on one of said second zones in accordance with said preselected angle; and (iv) second evaluation means for evaluating said second signals from said second light sensor;

said first and second longitudinal axes being parallel, and said second measuring device being turned about said second longitudinal axis with respect to said first measuring device by approximately 90°.

13. The system according to claim 12 wherein said second measuring device is turned around said second longitudinal axis by about 45° with respect to a reference plane defined by said first and second light sources.

* * * * *